US006296486B1

(12) United States Patent
Cardaillac et al.

(10) Patent No.: US 6,296,486 B1
(45) Date of Patent: Oct. 2, 2001

(54) MISSILE FIRING SIMULATOR WITH THE GUNNER IMMERSED IN A VIRTUAL SPACE

(75) Inventors: Emmanuel Cardaillac, St Georges sur Moulon; Laëtitia Weber, Lazenay, both of (FR)

(73) Assignee: Aerospatiale Societe Nationale Industrielle, Paris (FR)

( * ) Notice: Subject to any disclaimer, the term of this patent is extended or adjusted under 35 U.S.C. 154(b) by 0 days.

(21) Appl. No.: 09/367,112

(22) PCT Filed: Dec. 23, 1998

(86) PCT No.: PCT/FR98/02846

§ 371 Date: Sep. 7, 1999

§ 102(e) Date: Sep. 7, 1999

(87) PCT Pub. No.: WO99/34163

PCT Pub. Date: Jul. 8, 1999

(30) Foreign Application Priority Data

Dec. 23, 1997 (FR) ..... 97 16517

(51) Int. Cl.[7] ..... F41J 5/08; F41G 3/00

(52) U.S. Cl. ..... 434/12; 434/19; 434/20; 463/5; 273/358

(58) Field of Search ..... 434/11, 12, 14, 434/16–22, 27, 307 R, 308, 365; 463/2, 5, 34, 47, 49, 51, 52; 273/348.1, 358, 359, 371; 473/578, 583; 348/121, 141, 836; 89/1.11, 41.06; 353/11; 356/5.03, 141.1

(56) References Cited

U.S. PATENT DOCUMENTS

| | | | | |
|---|---|---|---|---|
| 3,701,206 | * | 10/1972 | Ormiston | 434/12 |
| 4,232,456 | | 11/1980 | Harmon et al. . | |
| 4,290,757 | * | 9/1981 | Marshall et al. | 434/12 |

FOREIGN PATENT DOCUMENTS

| | | |
|---|---|---|
| 2 746 534 A1 | 4/1976 | (DE) . |
| 41 11935 A1 | 10/1992 | (DE) . |
| 0 090 323 A1 | 10/1983 | (EP) . |
| 0 100 719 A1 | 2/1984 | (EP) . |
| 0 151 053 B1 | 8/1985 | (EP) . |
| 0 623 799 A1 | 11/1994 | (EP) . |
| 0 806 621 A1 | 11/1997 | (EP) . |
| 2 029 554 | 3/1980 | (GB) . |
| 2 041 177 | 9/1980 | (GB) . |
| 2 260 188 | 4/1993 | (GB) . |
| WO 83/01832 | 5/1983 | (WO) . |

OTHER PUBLICATIONS

Patent Abstracts of Japan, *Virtual Space Presentation System*, Publication No. 09113191, May 2, 1997.

Patent Abstracts of Japan, *Pseudo Visibility Device*, Publication No. 09138637, May 27, 1997.

* cited by examiner (List continued on next page.)

*Primary Examiner*—Joe H. Cheng
(74) *Attorney, Agent, or Firm*—Burns Doane Swecker & Mathis

(57) ABSTRACT

A simulator for simulating the firing of weapons the simulator including a firing station, and a missile weapon simulator. The missile weapon simulator able to simulate imaginary firings, an image display device, an image processing device, and an instructor station. The instructor station includes a video screen associated with a decision device by which an instructor chooses a virtual scenario relating to a firing field, the type of the missile and firing conditions. The image display device displays virtual images in actual size representing a field of vision of a firer in the virtual scenario chosen by the instructor, a micromonitor placed upon the missile weapon simulator displays the same images as those of the display device. The image processing device generates images within the instructor station, the images displayed on the micromonitor, and the images displayed on the display device.

20 Claims, 2 Drawing Sheets

U.S. PATENT DOCUMENTS 4,315,689 * 2/1982 Goda ..... 356/141.1
4,439,156 * 3/1984 Marshall et al. ..... 434/12
4,464,974 * 8/1984 Goda ..... 89/41.06
4,824,374 * 4/1989 Hendry et al. ..... 434/22
5,215,462 * 6/1993 Lewis et al. ..... 434/19
5,224,860 7/1993 Waldman et al. .
5,256,066 * 10/1993 LaRussa ..... 434/21
5,340,115 * 8/1994 Shirai et al. ..... 463/5
5,641,288 6/1997 Zaenglein, Jr. .
5,649,706 * 7/1997 Treat, Jr. et al. ..... 273/358
6,106,297 * 8/2000 Pollak et al. ..... 434/16

MISSILE FIRING SIMULATOR WITH THE GUNNER IMMERSED IN A VIRTUAL SPACE

DESCRIPTION

1. Field of the Invention

This invention concerns a missile firing simulator for training firers in the firing of missiles and immersing them in a virtual space and offering them different scenarios.

2. State of the Art

For training firers (also referred to as "pupils") in the firing of missiles, it is known that simulation devices can be used. These make it possible to train firers by teaching them to aim and fire at a target without using real projectiles and, in particular, missiles. Generally, in these simulation devices, the projectile is an imaginary projectile; a computer defines the position of the imaginary projectile, compares this position with that of the target aimed at, and assess the quality of the firing by determining notably whether the aiming (or sighting) would, if the firing were real, lead the projectile to an impact on the target.

There currently exist simulation systems based on the association of a laser system for locating the direction of aim of the firer with video reconstruction effected either by projecting the landscape displayed by the firer on a screen, or by sending this landscape to a micromonitor integrated in the firing station. Such devices are described notably in patent applications FR-A-2 531 201, EP-A-0 151 053 and EP-A-0 100 719 of Giravions Dorand SA.

In these devices, the position of the firer is fixed, which means that only angular movements of the firing station are allowed. However, it is important that the firer has a broadened view of the firing field and that he does not limit himself to inspecting the sector situated just in front of him. This is because, at the start of the exercise, several positions, by default, are permitted to a firer, which must be preserved throughout the period of firing. However, for standing or kneeling positions, it is impossible to guarantee that the pupil will keep these initial positions throughout the period of the firing. A modification of these initial positions therefore gives rise to errors in guiding the missile. In addition, before initiating the firing exercise, the simulator must be harmonised so as to ensure the matching of the projected image, or the image sent to the micromonitor, with the acquisition space of the camera which locates the laser beam relating to the pupil. In addition, the pupil may experience sensations of unease due to the shift existing between what he feels at the moment of firing and what he sees on the screen.

Such devices therefore have the drawback of not offering realism and sufficient comfort in use for the firers.

These devices also have the drawback of requiring the use of a laser system, as well as an acquisition camera, which gives rise to difficulties in harmonisation and use.

DISCLOSURE OF THE INVENTION

The aim of the invention is precisely to remedy the drawbacks of the devices described above. To this end, it proposes a device for simulating the firing of missiles from the shoulder or on a tripod aimed at improving the realism and comfort in use of the firers during their training by immersing them in a virtual space.

More precisely, the invention concerns a missile firing simulator for training missile firers from the shoulder or on a tripod, on fixed or moving targets, which includes:

at least one firing station provided with means of triggering imaginary firings;

image display means;

image processing means; and an instructor station, characterised in that:

the instructor station includes a video screen associated with decision means by which an instructor chooses a virtual scenario relating to the firing field, the type of missile and the firing conditions;

the firing station has spatial location means;

the image display means comprise a display device displaying virtual images, in actual size, representing the field of vision of the firer in the scenario chosen by the instructor and a micromonitor placed in the firing station and displaying the same images as those of the display device, but enlarged according to a predefined coefficient; and the image processing means include a central processing unit associated with an image generator generating the images of the instructor station, the images of the micromonitor and the images of the display device.

Advantageously, the image generator is able to generate two images simultaneously on the instructor station, one of the images being a plan view of the firing field and the other image representing the field of vision of the instructor in the process of observing the firing scene.

According to the invention, the simulator is able to generate a different reticule for each type of weapon system. It can also generate images of the firing field according to a variable brightness, representing variations in climate and sunshine.

According to one embodiment of the invention, the simulator has means of reconstructing interference caused by the departure of the missile.

According to one embodiment of the invention, the instructor station has means of storing each firing exercise in order to allow a subsequent analysis of the result of the firing.

DETAILED DESCRIPTION OF EMBODIMENTS OF THE INVENTION

The invention concerns a missile firing simulator intended for training missile firers firing on moving targets, by integrating the firer into a virtual space.

The simulator which has just been described is intended to facilitate training in firing missiles on a moving target, which can be a land vehicle, a tank, or a flying object, for example a helicopter. In the remainder of the description reference will simply be made to moving targets.

This missile firing simulator is based on a central unit responsible for processing data and two work stations: an instructor station and a firer station.

"Firer station or weapon simulator" means the assembly consisting of an adapted firing station, a munition tube equipped with any weight release system and means of displaying the firing field. The adapted firing station is identical to a firing station which is real, from an ergonomic point of view (the position of the controls, weights, centerings), but whose functions have been replaced by functions related to the simulation.

Such a firing station is described, notably, in the patent application FR-A-2 685 464, filed in the name of the applicant.

Unlike the real firing station, the adapted firing station of the invention has no aiming system; this is replaced by a micromonitor on which the virtual images representing the field of vision of the firer are displayed, in a format (dimensions, magnification) identical to that of the view through the aiming system of a real firing station. On this micromonitor there are displayed the virtual images representing the virtual space in which the firer moves, "in exercise".

In addition, this firing station of the invention has a three-dimensional (3D) position sensor, positioned, at least partly, within the launch tube. This 3 D position sensor, also referred to as a "spatial location device", makes it possible to determine the movements of the firing station during the firing exercise. This 3 D position sensor sends the data relating to these movements to the central unit, which analyses them and derives therefrom the effects on the simulated flight of the missile and on the displayed image.

The instructor station is the station from which the instructor creates the training scenario which he will offer to the pupil, initiates the training exercises, guides the pupil and analyses the results of the firing and the behaviour of the pupil during the exercise. This instructor station may be physically remote from the firer station. It is connected to the firer station by means of a central unit, which will be described more precisely below. This instructor station has a video screen which can display several images on demand and decision means enabling it to send instructions to the firer station, via the central unit.

Figure 1:
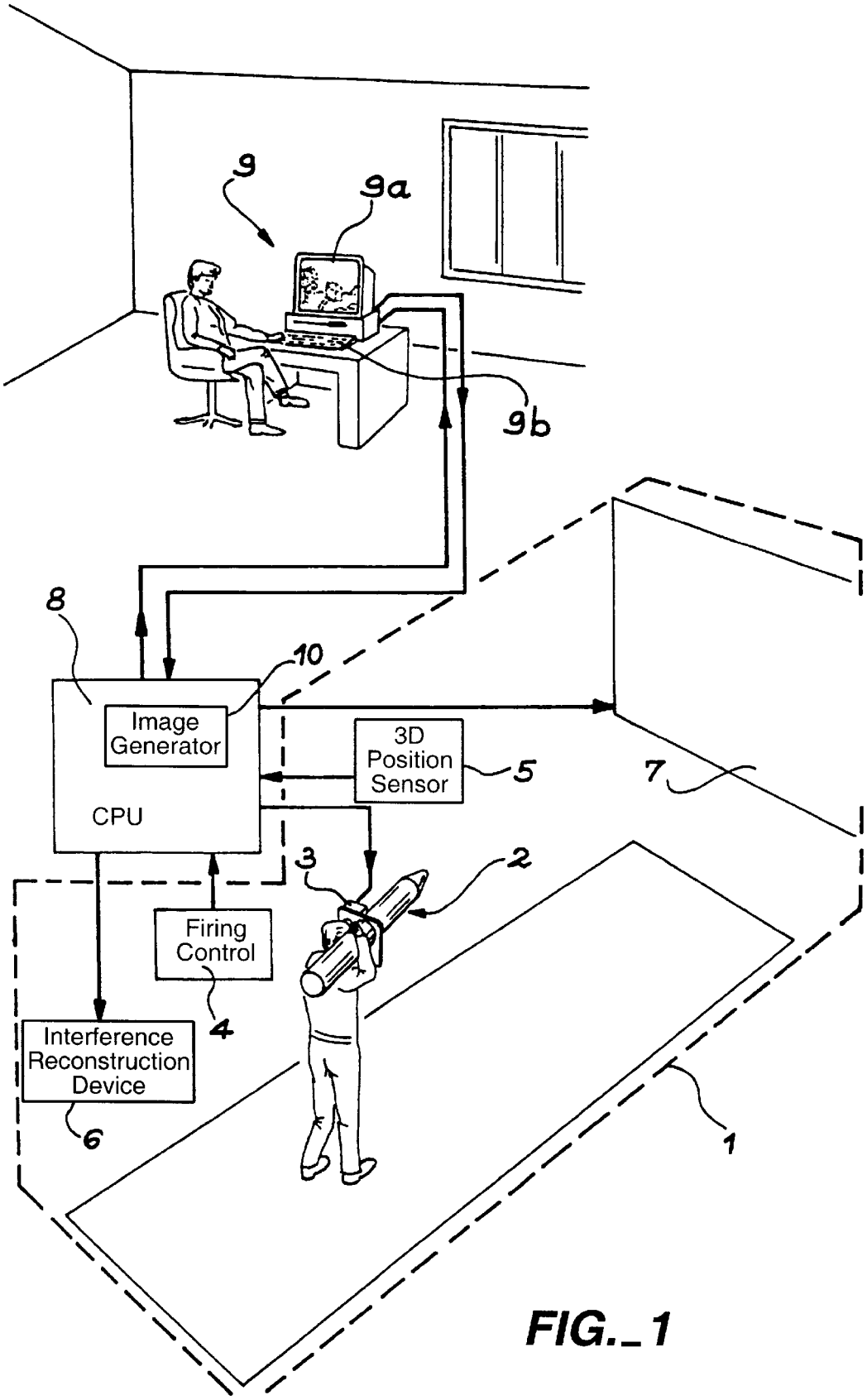
FIG. 1 depicts schematically the different elements constituting the device of the invention, and their connections.

This instructor station, and the firer station, are depicted schematically in FIG. 1. In this FIG. 1, the firer station bears the reference 1, the central processing unit the reference 8 and the instructor station the reference 9.

More precisely, the instructor station 9 comprises a video screen 9A associated with decision means 9B, such as a keyboard, a mouse, etc. It is from this instructor station 9 that the instructor will create the scenario in which the firer will be trained. A scenario means the whole consisting of the three-dimensional graphical object representing the firing field, the type of missile which the pupil must launch, target paths and the firing conditions. This scenario is determined from a choice of terrains offered by the simulator to the instructor. The latter chooses one of these terrains, and then chooses, on this terrain, certain firing conditions, such as the location where the firer is placed and his angle of sight. The instructor also chooses, on this terrain, the location where he himself must be placed in order to be able to visualise both the firer and the moving target. The instructor also defines the paths of the different targets.

He can also choose the type of weapon system in which the pupil will train, each weapon system being characterised by different guidance/control laws, different kinematic parameters and a dedicated firing station and reticule.

The instructor can also choose other firing conditions, such as the climatic and sunshine conditions in which the firer will have to work: day, night, fog etc. These firing conditions can be modified by the instructor, even during the exercise.

The instructor station can include a storage means intended to store the scenarios, and the result of the firings, so as subsequently to permit analysis of the missile firing.

The firer station 1 has a weapon simulator 2 already described, provided with a firing control 4 (that is to say the firing button associated with the handle of the weapon simulator, already described), a spatial location device 5 (3 D position sensor), and a micromonitor 3.

According to one embodiment of the invention, the firer station has an interference reconstruction device, referenced 6.

These elements 4, 5, and 6 are in fact fixed to the weapon simulator 2, but have been shown diagrammatically in FIG. 1, by blocks, so as to simplify the figure.

The firer station 1 also comprises a display device 7, which can be a standard video screen or, preferably, a large screen. This display device 7 displays images identical to those displayed by the micromonitor 3. However, the images displayed on this device 7 are of real size, whilst the images displayed by the micromonitor are magnified according to a coefficient correspondent to that of the standard aiming system of the weapon system so that the image seen by the firer corresponds (in format) to the image which a firer sees on a real firing station.

The purpose of the simultaneous use of the display device 7 and the micromonitor 3 is to enable the firer to see the scene without magnification when he raises his head, thus ensuring his immersion in virtual space. The training of the firer thus takes place under conditions which resemble the real firing conditions as far as possible.

The spatial location device 5, placed, at least partly, in the launch tube, makes it possible to determine the position and attitudes of the firer. When these have been acquired, they are transmitted to the central unit, which derives therefrom the position of the firer in virtual space. In order to take into account all the changes and positions of the firer, the sensor used is a sensor with 6 degrees of freedom (according to 3 axes and 3 angles). This sensor can, for example, be an electromagnetic system which has the advantage of being stable and not exhibiting any drift over time. In particular, it is possible to use the FASTRAK model from the company POLHEMUS®. This electromagnetic sensor has, in particular, a receiver positioned in the launch tube and associated with a transmitter situated outside the launch tube and representing the fixed reference.

The position sensor can also be a gyrometric sensor, which has the advantage of being accurate and insensitive to surrounding electromagnetic waves. Other types of 3 D position sensor can also be envisaged.

The role of the central unit 8 is to interpret the commands of the instructor, to restore the scenario chosen by the instructor to the instructor station and to the firer station, to take into account the firing command and to make it possible, if necessary, to use interference reconstruction devices. This central unit can, for example, be a synthesis image generator, or a computer of the PC type.

When the scenario is defined by the instructor, the instructions relating to this scenario are sent to the central unit 8 which, in association with an image generator 10, generates all the images necessary for the exercise. More precisely, it is the image generator 10 which forms all the images from data supplied by the central unit 8. It generates, in particular, the image or images for the instructor station. According to the preferred embodiment of the invention, the instructor station displays two images: a map of the firing field and a view representing the field of vision of the instructor when he is looking at the firer. The image generator 10 also generates two other images intended for the firer station.

This image generator can, for example, be the Onyx Reality Engine$^2$ image generator sold by Silicon Graphics and associated, in the simulator of the invention, with a Multi Channel Option box also sold by Silicon Graphics.

It should be noted that the simulator of the invention has just been described in the case where it has only one firer station; it can, however, include several firer stations. Two embodiments are then possible: the one where each firer station is associated with its own image generator and the one where all the firer stations are associated with the same image generator.

In addition, as described in patent application FR-A-2 685 464 of the applicant, different interferences are present when a missile is fired:

interference related to the release of the weight of the missile;

lateral interference related to the friction generated by the missile as it leaves the tube;

interference related to the traction force of the wire on the firing station, when it is a case of a wire-guided missile.

In order to simulate these interferences, an interference reconstruction device is used, represented by the block 6 in FIG. 1 and described in the patent application FR-A-2 685 464.

Figure 2:
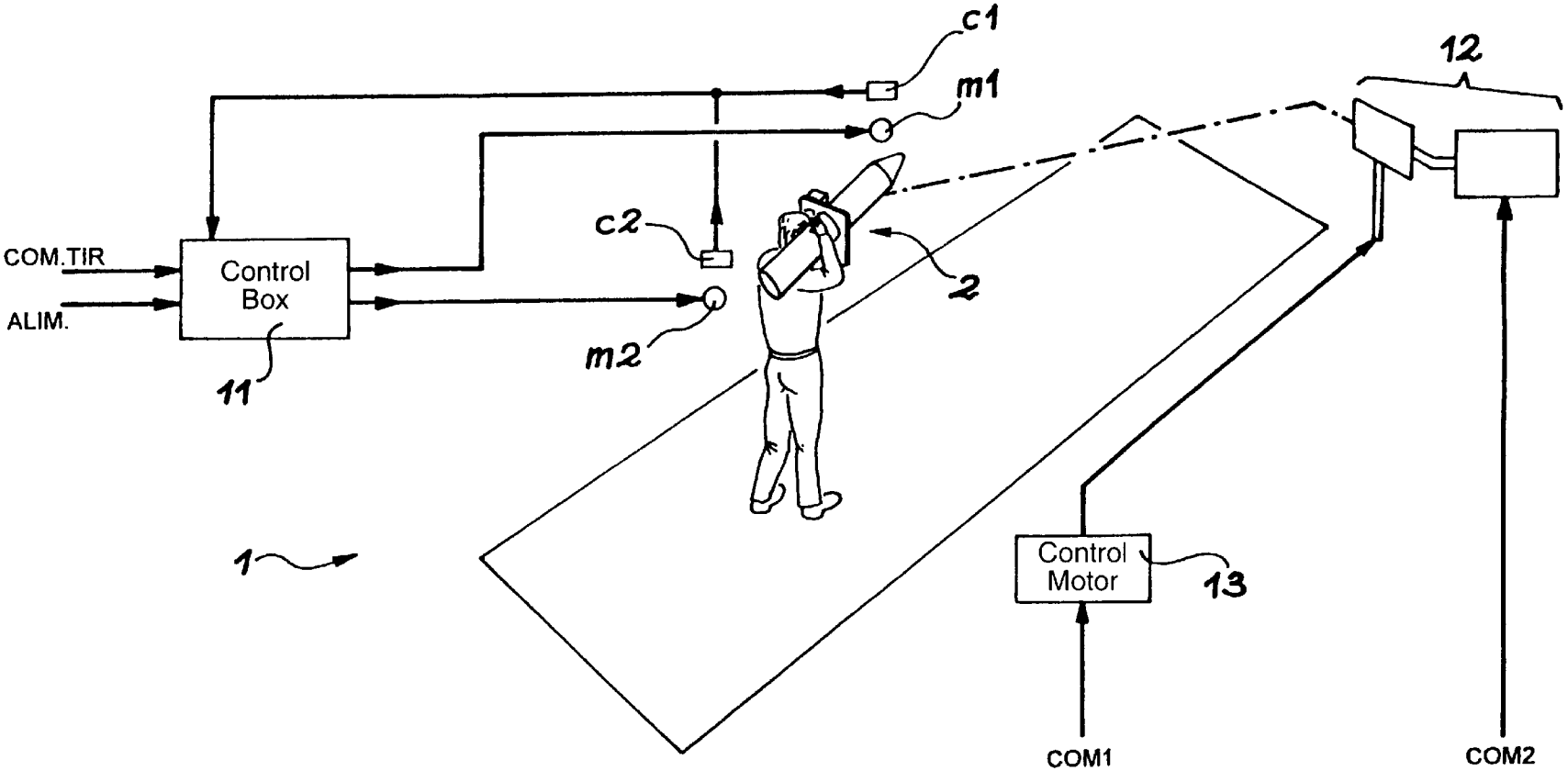
FIG. 2 depicts schematically the principle of reconstruction of the interference due to the missile leaving the firing station.

For a better understanding of the invention, FIG. 2 depicts this device for reconstructing the interference caused by the launching of the missile.

This device has a system of weights m1, m2, positioned in the launch tube, and ejected out of the tube during the imaginary launching of the missile. This device also has proximity sensors c1, c2 disposed on the axis where the electromagnetic weights are fixed. These sensors serve to detect the presence of the weights in order to know whether or not it is necessary to supply them with energy, that is to say in order to known whether or not these weights must be released. In other words, these proximity sensors supply, to a box controlling the weights 11, information relating to the presence or not of the weights. This control box 11 also receives information relating to the firing command and the energy supply necessary for releasing the weights m1 and m2.

This interference reconstruction device also includes a wire traction system, referenced 12, whose role is to reconstruct the interference due to the traction force of the wire on the firing station, when the missile is wire guided. This wire traction box 12 is controlled by a command COM2 which is generated by the simulator after a time $\Delta t$ after the missile has left. So that the traction of the wire is always exerted in the direction of the missile, as is the case with real firing stations, the wire traction system 12 is slaved to the position relative to the firing station with respect to the missile, by a control motor 13, controlled by a command COM1.

What is claimed is:

1. A missile firing simulator for training a firer for firing a missile from the shoulder or a tripod, the missile fired on fixed or moving targets, the missile firing simulator including:

at least one firing station, the firing station including a weapon simulator, the weapon simulator provided with a triggering device for triggering imaginary firings;

an image display device;

an image processing device; and an instructor station wherein the instructor station includes a video screen associated with a decision device by which an instructor chooses a virtual scenario relating to a firing field, the type of the missile and firing conditions, the firing station further including a spatial location device, the image display device displays virtual images in actual size representing a field of vision of a firer in the virtual scenario chosen by the instructor, a micromonitor disposed upon the missile weapon simulator displaying the same images as those displayed on the display device, but enlarged according to a predetermined coefficient, and the image processing device includes a central processing unit associated with an image generator, wherein the image processing device generates images within the instructor station, images displayed on the micromonitor, and the images displayed on the display device.

2. The missile firing simulator according to claim 1, characterized in that the image generator is able to generate two images simultaneously on the instructor station, one of the images being a 3 D plan view of the firing station and the other image representing a field of vision of the instructor in the process of observing the firing station.

3. The missile firing simulator according to claim 2, characterized in that the missile firing simulator is able to generate a reticule for each type of missile.

4. The missile firing simulator according to claim 2, characterized in that the missile firing simulator is able to generate firing field images according to variable brightness representing variations in climate and sunshine.

5. The missile firing simulator according to claim 2, characterized in that the missile firing simulator further includes an interference reconstruction device for reconstructing the interference due to the missile leaving the firing station.

6. The missile firing simulator according to claim 2, characterized in that the instructor station has means of storing each firing exercise to allow subsequent analysis of the result of the firing.

7. The missile firing simulator according to claim 1, characterized in that it is able to generate a reticule for each type of missile.

8. The missile firing simulator according to claim 7, characterized in that the missile firing simulator is able to generate firing field images according to variable brightness representing variations in climate and sunshine.

9. The missile firing simulator according to claim 7, characterized in that the missile firing simulator further includes an interference reconstruction device for of reconstructing the interference due to the missile leaving the firing station.

10. The missile firing simulator according to claim 7, characterized in that the instructor station has means of storing each firing exercise to allow subsequent analysis of the result of the firing.

11. The missile firing simulator according to claim 1, characterized in that the missile firing simulator is able to generate firing field images according to variable brightness representing variations in climate and sunshine.

12. The missile firing simulator according to claim 11, characterized in that the missile firing simulator further includes an interference reconstruction device for of reconstructing the interference due to the missile leaving the firing station.

13. The missile firing simulator according to claim 11, characterized in that the instructor station further includes a storage device for storing each firing exercise to allow subsequent analysis of the result of the firing.

14. The missile firing simulator according to claim 1, characterized in that the missile firing simulator further includes an interference reconstruction device for reconstructing the interference due to the missile leaving the firing station.

15. The missile firing simulator according to claim 14, characterized in that the instructor station further includes a storage device for storing each firing exercise to allow subsequent analysis of the result of the firing.

16. The missile firing simulator according to claim 1, characterized in that the instructor station further includes a storage device for storing each firing exercise to allow subsequent analysis of the result of the firing station.

17. The missile firing simulator according to claim 1, characterized in that the spacial location device includes six degrees of freedom.

18. The missile firing simulator according to claim 17, characterized in that six degrees of freedom comprise three axes and three angles.

19. A fire simulator, the firs simulator comprising:

at least one firing station, said firing station including a weapon simulator wherein the weapon simulator including a triggering device and a micromonitor disposed thereupon;

an image display device;

wherein the image display device displays virtual images in actual size, said virtual images representing a field of vision of a firer on a screen and on said micromonitor;

an image processing device, said image processing device including a central processing unit operatively coupled for communication with an image generator; and an instructor station, said instructor station includes a video screen associated with a decision device by which an instructor choose a virtual scenario relating to a firing field, the type of the missile and firing conditions;

wherein the image processing device generates images within the instructor station, images displayed on the micromonitor, and the images displayed on the display device.

20. The firing simulator according to claim 19, wherein the simulator further includes a spacial location device, the spacial location device including six degrees of freedom.

* * * * *